US006347967B1

(12) United States Patent
Tamm

(10) Patent No.: US 6,347,967 B1
(45) Date of Patent: Feb. 19, 2002

(54) ELECTRICAL CONNECTOR

(75) Inventor: Carl R. Tamm, Jonesborough, TN (US)

(73) Assignee: Pan Electric Corporation, Carson City, NV (US)

( * ) Notice: Subject to any disclaimer, the term of this patent is extended or adjusted under 35 U.S.C. 154(b) by 0 days.

(21) Appl. No.: 09/574,049

(22) Filed: May 18, 2000

(51) Int. Cl.[7] ..... H01R 4/40

(52) U.S. Cl. ..... 439/806; 439/789; 439/812; 403/322.1

(58) Field of Search ..... 439/806, 807, 439/838, 789, 790, 793, 794, 796, 811, 812; 403/322.1, 322.3, 374.2

(56) References Cited

U.S. PATENT DOCUMENTS

| | | | | |
|---|---|---|---|---|
| 3,990,129 A | | 11/1976 | Cornell et al. | 439/789 |
| 4,357,068 A | | 11/1982 | Cornell et al. | 439/789 |
| 4,479,694 A | | 10/1984 | Cornell et al. | 439/789 |
| 4,548,462 A | | 10/1985 | Cornell | 439/789 |
| D296,777 S | | 7/1988 | Cornell | D13/12 |
| 4,861,290 A | * | 8/1989 | Halmstad et al. | 439/810 |
| 4,898,551 A | | 2/1990 | Cornell | 439/789 |
| 5,401,194 A | | 3/1995 | Cornell | 439/789 |
| 5,466,176 A | | 11/1995 | Cornell et al. | 439/789 |
| 5,690,516 A | * | 11/1997 | Fillinger | 439/798 |
| 5,765,962 A | | 6/1998 | Cornell et al. | 439/789 |

FOREIGN PATENT DOCUMENTS

| | | | | |
|---|---|---|---|---|
| GB | 0563909 | | 9/1944 | |
| GB | 1145085 | * | 3/1969 | 439/806 |

OTHER PUBLICATIONS

U.S. Patent Application Ser. No. 09/664,909, filed Sep. 18, 2000.
U.S. Patent Application Ser. No. 09/551,280, filed Apr. 18, 2000.
Search Report dated Aug. 24, 2001.

* cited by examiner

*Primary Examiner*—Paula Bradley
*Assistant Examiner*—Briggitte R. Hammond
(74) *Attorney, Agent, or Firm*—Brinks Hofer Gilson & Lione

(57) ABSTRACT

An electrical connector for a threaded shaft includes first and second connector elements, each defining a respective partial-cylindrical threaded surface, a respective hinge element, and a respective tail. The hinge elements are coupled together at a hinge axis such that the connector elements rotate about the hinge axis to move the threaded surfaces toward and away from one another. The threaded surfaces are oriented to contact and intermesh with opposed sides of a threaded shaft, and a fastener holds the tails together to clamp the threaded shaft between the threaded surfaces. A third connector element cooperates with the first connector element to clamp against and establish electrical contact with a cable.

23 Claims, 4 Drawing Sheets

S
3
50
12
3
10
C
5
70
5

Fig. 5
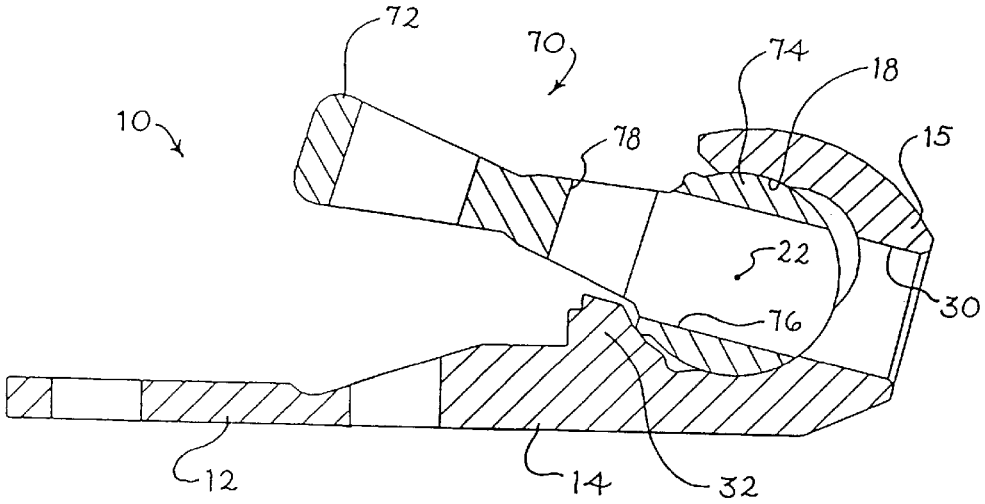
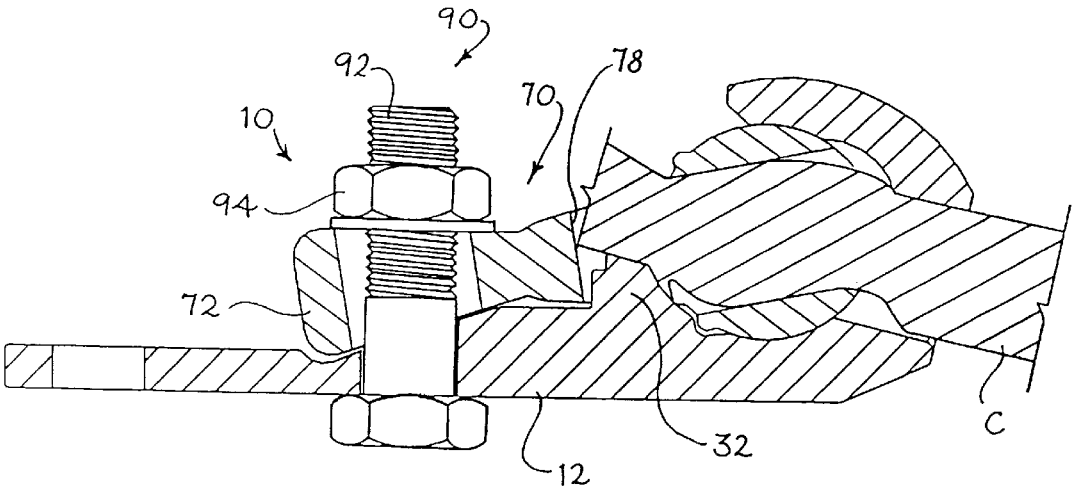
Fig. 6

ELECTRICAL CONNECTOR

BACKGROUND

The present invention relates to electrical connectors for threaded shafts and cables, and in particular to improvements to connectors of the type including first and second connector elements that are movable relative to one another about a hinge axis.

The assignee of the present invention has patented a number of commercially successful electrical connectors. See for example the cable connector disclosed in Cornell U.S. Pat. No. 4,357,068. This connector clamps the cable being terminated by rotating a connector element from a first position, in which two cable-receiving openings are aligned, to a second position, in which the cable-receiving openings are misaligned. The cable clamping device of the Cornell patent provides the particular advantage that the elements of the connector can be assembled in either first or second orientations to clamp two different sizes of cable.

Cornell U.S. Pat. No. 3,990,129, also assigned to the assignee of the present invention and hereby incorporated by reference in its entirety, discloses a multi-cable connector for use with a different type of cable clamping device. The disclosed multi-cable connector includes an elongated cylinder on which various C-shaped elements are mounted for rotation. Each of the C-shaped elements defines a cable-receiving opening that can be selectively aligned or misaligned with a corresponding cable-receiving opening of the cylinder.

Cornell U.S. Pat. No. 5,765,962, also assigned to the assignee of the present invention, discloses a ground rod connector that receives an unthreaded ground rod between two hinged elements, wherein the ground rod is oriented parallel to the hinge axis.

A need presently exists for an improved electrical connector for connecting one or more cables to a threaded shaft, such as the threaded stud of a typical power transformer.

BRIEF SUMMARY

By way of introduction, the preferred embodiment described below includes a first connector element having a first partial-cylindrical threaded surface, a first hinge element, and a first tail. The illustrated electrical connector includes a second connector element having a second partial-cylindrical threaded surface, a second hinge element, and a second tail. The hinge elements are coupled together at a hinge axis, and the connector elements rotate about the hinge axis to move the threaded surfaces toward and away from one another. The threaded surfaces are oriented to contact and intermesh with opposed sides of a threaded shaft, and a fastener is provided to hold the tails together, thereby clamping the threaded shaft between the threaded surfaces. In the illustrated embodiment the threaded surfaces each extend over a cylinder arc of less than about 140°.

Additional connector elements may be provided that cooperate with the first connector element to clamp and electrically connect one or more cables to the first connector element.

The foregoing paragraphs have been provided by way of introduction, and they are not intended to limit the scope of the following claims.

BRIEF DESCRIPTION OF THE DRAWINGS

FIG. 5 is a cross-sectional view taken along line 5—5 of FIG. 1, showing one of the third connector elements 70 in an opened position.

FIG. 6 is a sectional view in the plane of FIG. 5, showing the third connector element 70 in a closed position, clamped on a cable C.

DETAILED DESCRIPTION OF THE PRESENTLY PREFERRED EMBODIMENTS

Figure 1:
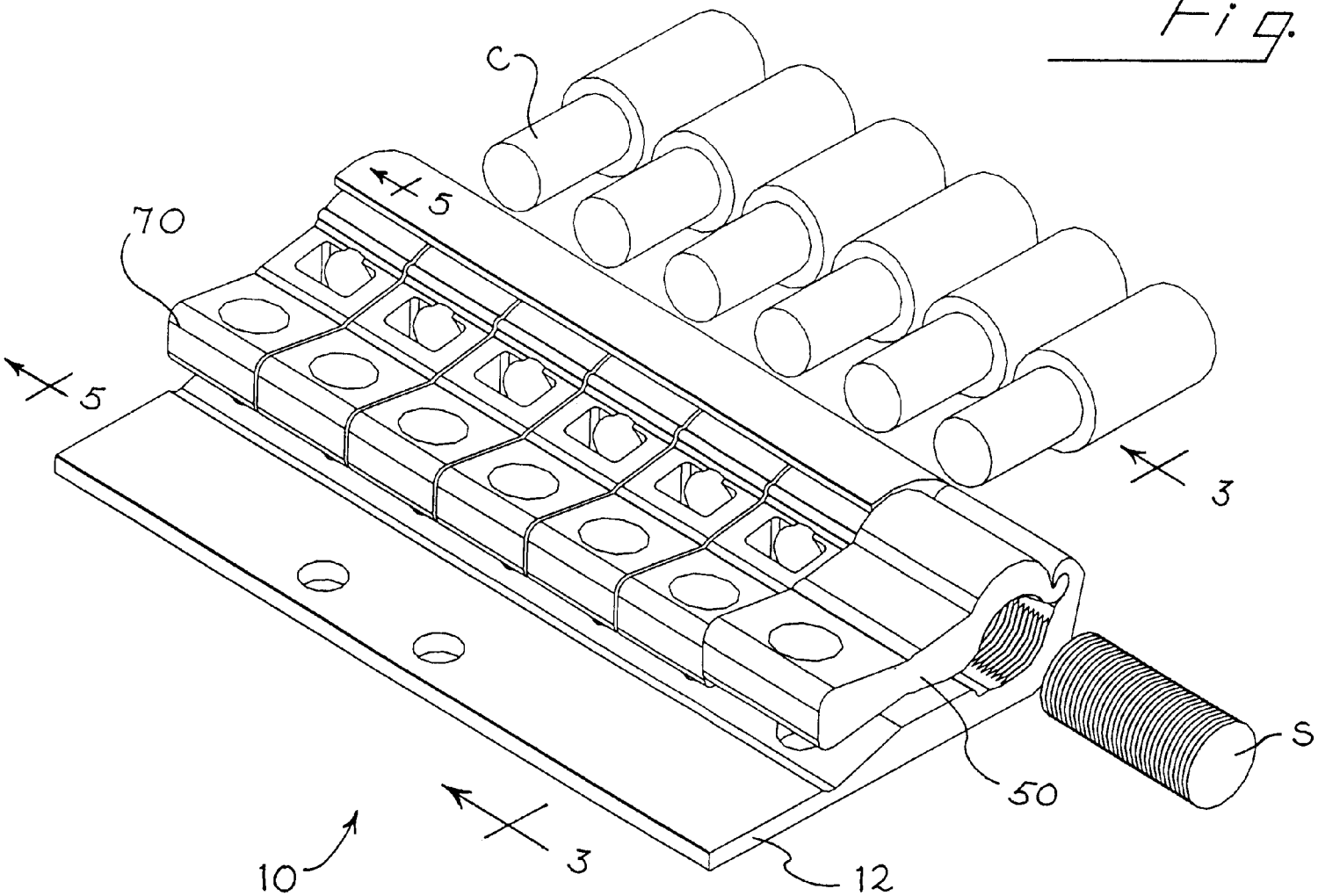
FIGS. 1 and 2 are rear and front perspective views, respectively, of an electrical connector that incorporates a preferred embodiment of this invention.
Figure 2:
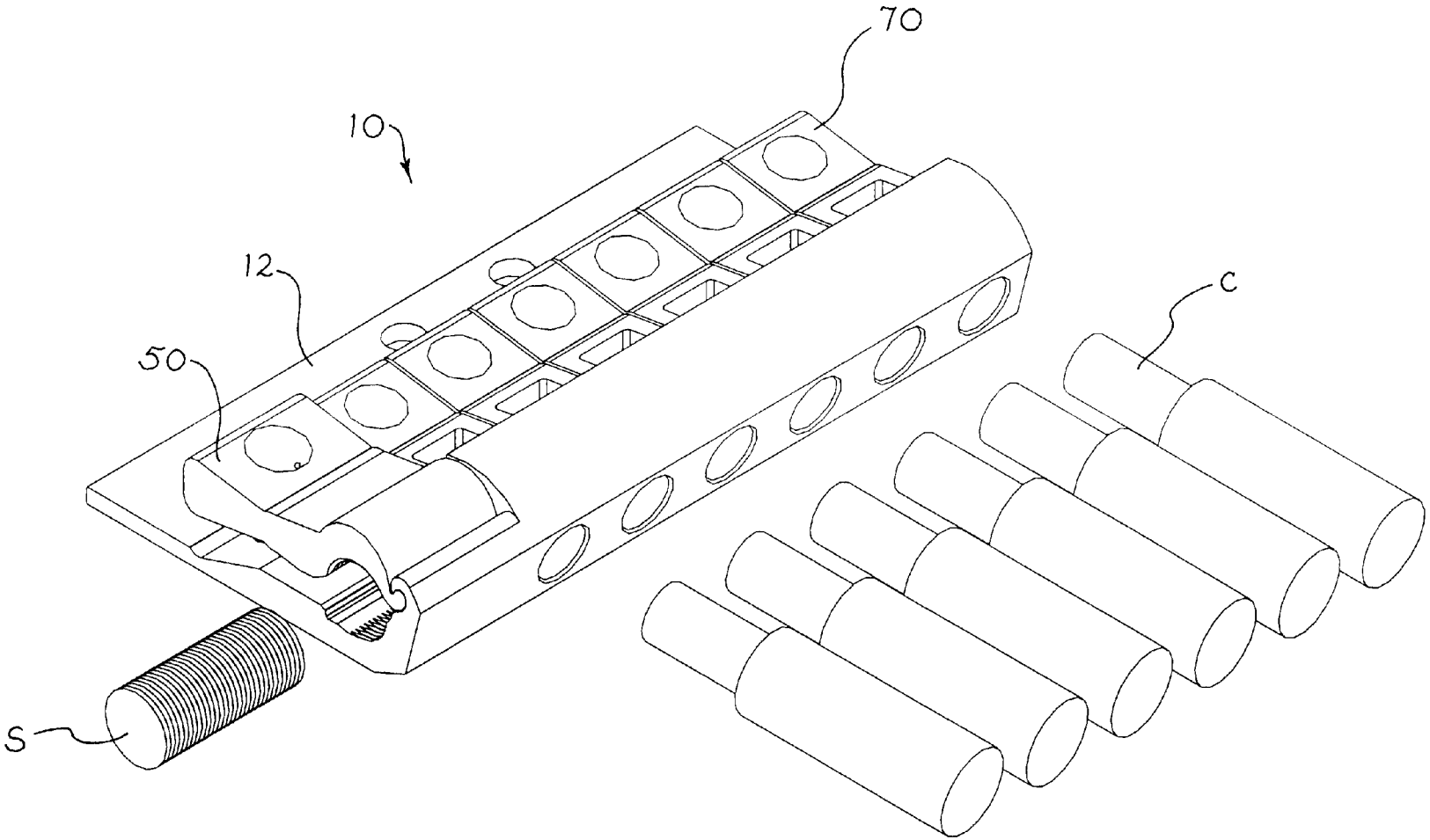

Turning now to the drawings, FIGS. 1 and 2 show general views of an electrical connector 10 that incorporates a preferred embodiment of this invention. This electrical connector 10 includes a base 12 (sometimes referred to as a first connector element in the following description), a second connector element 50 and one or more third connector elements 70.

Figure 3:
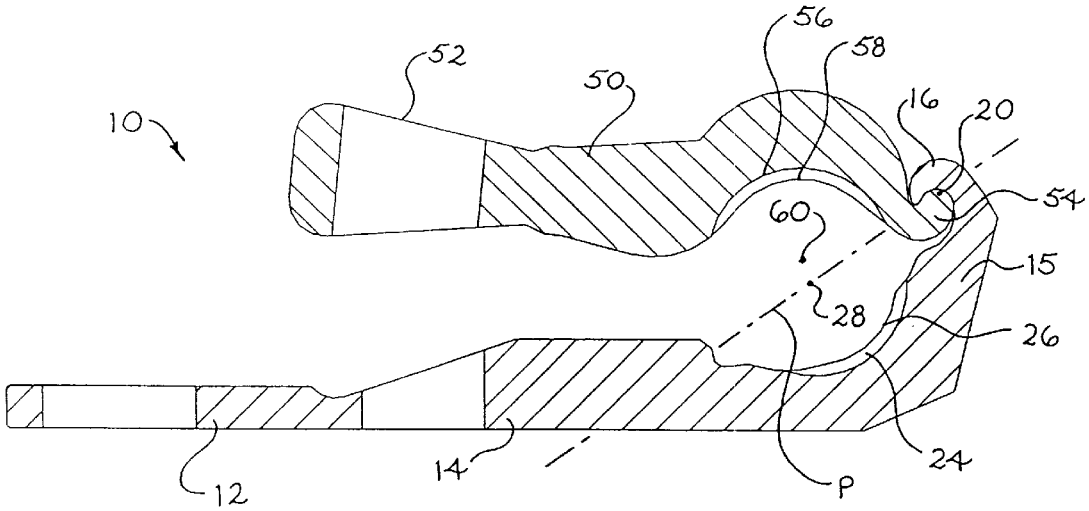
FIG. 3 is a cross-sectional view taken along line 3—3 of FIG. 1, showing the second connector element 50 in an opened position.

As best shown in FIG. 3, the base 12 includes a first tail 14 and an upstanding flange 15 at one end of the tail 14. This flange 15 forms a hinge element 16. The hinge element 16 defines a hinge axis 20 that operates as described below to control hinging movement of the second connector element 50.

A first threaded surface 24 is formed on the base 12 near the junction between the flange 15 and the tail 14. This first threaded surface 24 defines an array of threads 26 and is generally partially cylindrical in shape, centered about a first cylinder axis 28 that is parallel to the hinge axis 20. The threads 26 extend over a cylinder arc (measured with respect to the first cylinder axis 28) that is less than 180°, preferably less than 160°, more preferably less than 140°, and most preferably about 110°.

As best shown in FIG. 3, the second connector element 50 includes a second tail 52, a second hinge element 54, and a second threaded surface 56 therebetween. The second threaded surface 56 defines an array of threads 58 that are partially cylindrical in shape and that are centered on a second cylinder axis 60. The threads 58 extend over a cylinder arc (measured with respect to the second cylinder axis 60) that is less than 180°, preferably less than 160°, more preferably less than 140°, and most preferably about 135°. The threads 26, 58 are matched with one another such that they have the same cylinder diameter and the same number of threads per inch. The second cylinder axis 60 is parallel to the first cylinder axis 28.

As best shown in FIG. 5, the flange 15 also forms a socket 18, and in this embodiment socket 18 is axially aligned with the region between the threaded surfaces 24, 56 of FIG. 3. In alternative embodiments, the socket 18 may be positioned differently with respect to the threaded surfaces, e.g. oriented at right angles to the hinge axis 20, or on the opposite site of the base 12 from the threaded surfaces 24, 56. The socket 18 is generally cylindrically symmetrical about a pivot axis 22, and the socket 18 guides the pivoting movement of the third connector elements 70. The flange 15 also defines a set of openings 30 that communicate with the socket 18 (one for each of the third connector elements 70), and the tail 14 defines a set of protruding elements 32, each axially aligned with a respective one of the openings 30. In alternative embodiments the flange 15 can define any desired number of openings 30 and a corresponding number of protruding elements 32, depending upon the number of cables to be electrically connected with the threaded shaft.

Each third connector element 70 includes a third tail 72 that is rigidly connected to a partially cylindrical head 74. The head 74 defines an opening 76, and the third tail 72 defines a window 78 that communicates with the opening 76. The third connector elements 70 can if desired be identical to corresponding prior-art elements, such as those described in any of the following U.S. patents, all assigned to the assignee of the present invention and all hereby incorporated by reference: U.S. Pat. No. D-296,777, U.S. Pat. Nos. 4,357,068, 4,548,462, 4,479,694, 4,898,551, 5,401,194, 5,466,176, 5,765,962, and 5,919,065. Additionally, these elements may be formed as described in the following U.S. patent applications, also assigned to the assignee of the present invention and also incorporated by reference: U.S. Pat. application Ser. Nos. 60/164,181 and 60/158,012.

The first connector element 12 can be formed from an extrusion of a conductive alloy such as AL6082-T6. This extrusion is then machined to form the various features described above. Similarly, the second connector element 50 and the third connector element 70 can be formed from extrusions of a similar material and then machined as appropriate. The recess in the flange 15 below the hinge axis 20 may be formed by machining or extrusion techniques.

In this embodiment a plane P passing through the hinge axis 20 and the cylinder axis 28 also passes through the first tail 14 (FIG. 3). Also, the cylinder axes 28, 60 of FIG. 3 pass through the head 74 of FIG. 5 when the second connector element 50 is positioned to clamp a threaded stud S, and the first tail 14 is oriented generally tangentially to the first threaded surface 24.

Figure 4:
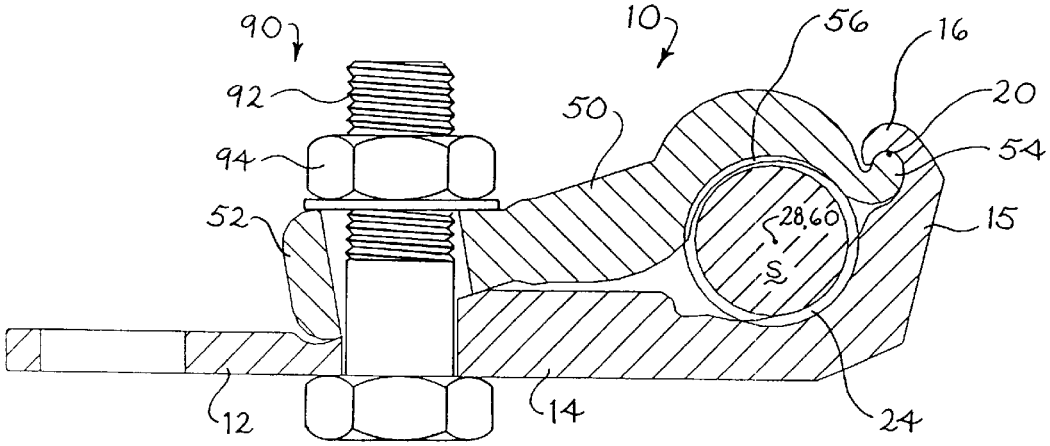
FIG. 4 is a sectional view in the plane of FIG. 3, showing the second connector element in a closed position, clamped on a threaded stud S.

In use, the clamping elements 50, 70 are clamped in position by fasteners 90, each including a bolt 92 and a nut 94 (FIGS. 4 and 6). The connector 10 is first assembled as shown in FIGS. 3 and 5. The second connector element 50 is then rotated clockwise in the view of FIG. 3 to separate the threaded surfaces 24, 56. The threaded stud S is then positioned between the threaded surfaces 24, 56 by moving the stud S or the base 12 parallel to the hinge axis 20, and a wrench (not shown) is used to rotate the nut 94 on the bolt 92 (FIG. 4). Rotation of the nut 94 moves the second tail 52 into contact with the base 12, thereby clamping the first and second threaded surfaces 24, 56 against opposed sides of the threaded stud S and causing the first and second threads 26, 58 to intermesh with opposed threads on the threaded stud S (FIG. 4). The hinge elements 16, 54 allow sufficient axial movement along the hinge axis 20 to ensure that the respective threads intermesh on both sides of the threaded stud S. When tightly clamped against the threaded stud S, the first and second cylinder axes 28, 60 are coincident with the center of the threaded stud S. The result is a secure mechanical and electrical termination for the threaded stud S, one that is obtained without the requirement of any relative rotation between the threaded stud S and the base 12.

Then one of the third connector elements 70 is rotated in the socket 18 to bring the opening 76 into alignment with the opening 30 (FIG. 5), and the cable C is inserted through the openings 30, 76 into the window 78. Then the nut 94 of the respective fastener 90 is rotated with a wrench (not shown) to move the third tail 72 into contact with the base 12, thereby applying substantial compressive forces to the cable C and bending the clamped cable C (FIG. 6). The protruding element 32 moves into the window 78 and bends the end of the cable C upwardly out of the window 78. The result is a secure mechanical termination for the cable C having excellent electrical contact between the connector 10 and clamped cable C. The patent documents described above can be referenced for a more detailed explanation of the manner in which the base 12 cooperates with the third connector element 70 and with the clamped cable C.

The connector 10 provides the advantage that many cables C can be terminated in a relatively compact space. Because a single base 12 can be used to mount many third connector elements 70, a substantial reduction is achieved in the number of required parts, the cost, and the size of the resulting assembly. Individual ones of the third connector elements 70 can be moved between a first, cable-receiving position and a second, cable-clamping position without disturbing the remaining third elements 70.

Additionally, the connector elements 12, 50 cooperate to form a spring compression connector that provides a secure, long-term, low-resistance connection with the stud S. The second connector element 50 is shaped such that the second tail 52 is spaced from the base 12 when the threaded surfaces 24, 56 are fully intermeshed with the threads of the stud S. As the fastener 90 is used to clamp the second tail 52 against the base 12, the second tail 52 and the base 12 are elastically deformed. This elastic deformation provides stored energy that maintains a high contact force on the stud S over an extended time period, in spite of vibration, thermal cycling and cold flow. This contact force can be made high enough to create a gas-tight seal with the threads of the stud S, thereby reducing or even substantially eliminating problems associated with corrosion or electrochemical reactivity at the stud S. In order to enhance the spring compression effect, it is preferred to use a material for the elements 12, 50, 70 that acts as a spring (i.e. deforms elastically rather than plastically) under operational conditions.

As another advantage, the base 12 provides a conductive path to distribute electrical current between the threaded stud S and all of the associated terminated cables C. Also, the base can be installed on or removed from the stud S without rotating the base 12 or removing the cables C.

Of course, many changes and modifications can be made to the preferred embodiment described above. More or fewer third connector elements 70 can be used with each base 12, and multiple second connector elements 50 can be used if desired. Other fasteners can be substituted for the fasteners described above. Additionally, many geometries can be used for the components described above. The opening 76 in the head 74 can be oriented at a skew angle with respect to the tail of the third connector element 70, or alternatively the opening 76 can be centered along the centerline of the third connector element 70. As another alternative, multiple openings can be provided in each head 74 and in the socket 18 associated with each of heads 74, such that two or more cables or rods can simultaneously be terminated with a single third connector element 70. See for example the designs shown in U.S. Pat. Nos. 5,765,962 and 5,919,065, assigned to the assignee of the present invention and hereby incorporated by reference. Sizes, dimensions, proportions and materials can all be adapted as appropriate for the particular application.

This invention is not restricted to use with extruded components as shown in the drawings. Other techniques can be used to form the connector elements, including the techniques described in U.S. Pat. No. 5,919,065.

As used herein, the term "misaligned" is intended broadly to cover misalignment in whole or in part. Thus, two openings that are skewed with respect to one another by a relatively small angle are still considered to be misaligned.

The term "position" is intended to encompass a range of positions. Thus, the cable clamping position described above can correspond to any one of a range of positions, depending upon the particular cable being clamped.

The term "set" is used to mean one or more.

The term "hinge element" is intended broadly to encompass hinge elements that directly engage one another as shown in the drawings, as well as barrel elements that engage separate pins and pin elements that engage separate barrels.

The foregoing detailed description has described only a few of the many forms that the present invention can take. For this reason, this detailed description is intended by way of illustration and not by way of limitation. It is only the following claims, including all equivalents, that are intended to define the scope of this invention.

What is claimed is:

1. An electrical connector for a threaded shaft, said connector comprising:

a first connector element comprising a first partial-cylindrical threaded surface, a first hinge element, and a first tail;

a second connector element comprising a second partial-cylindrical threaded surface, a second hinge element, and a second tail;

said hinge elements coupled together at a hinge axis such that the connector elements rotate about the hinge axis to move the threaded surfaces toward and away from one another, said threaded surfaces oriented to contact and intermesh with opposed sides of the threaded shaft;

a fastener operative to hold the tails together to clamp the threaded shaft between the threaded surfaces;

wherein each threaded surface extends over a cylinder arc of less than 180°.

2. The connector of claim 1 wherein the threaded surfaces each comprises a respective array of threads, each array of threads concentric with a respective cylinder axis, each cylinder axis parallel with the hinge axis.

3. The connector of claim 1 wherein each threaded surface extends over a cylinder arc of less than 160°.

4. The connector of claim 1 wherein each threaded surface extends over a cylinder arc of less than 140°.

5. The connector of claim 1 wherein each threaded surface extends over a cylinder arc of no more than about 135°.

6. The connector of claim 1 wherein the hinge elements are configured to accommodate movement of the first connector element relative to the second connector element parallel to the hinge axis to intermesh the first and second threaded surfaces with the threaded shaft.

7. An electrical connector for a threaded shaft, said connector comprising:

a first connector element comprising a first partial-cylindrical threaded surface, a first hinge element, and a first tail;

a second connector element comprising a second partial-cylindrical threaded surface, a second hinge element, and a second tail;

said hinge elements coupled together at a hinge axis such that the connector elements rotate about the hinge axis to move the threaded surfaces toward and away from one another, said threaded surfaces oriented to contact and intermesh with opposed sides of the threaded shaft;

a fastener operative to hold the tails together to clamp the threaded shaft between the threaded surfaces;

wherein the first tail extends tangentially away from the first threaded surface.

8. An electrical connector for a threaded shaft, said connector comprising:

a first connector element comprising a first partial-cylindrical threaded surface, a first hinge element, and a first tail;

a second connector element comprising a second partial-cylindrical threaded surface, a second hinge element, and a second tail;

said hinge elements coupled together at a hinge axis such that the connector elements rotate about the hinge axis to move the threaded surfaces toward and away from one another, said threaded surfaces oriented to contact and intermesh with opposed sides of the threaded shaft;

a fastener operative to hold the tails together to clamp the threaded shaft between the threaded surfaces;

wherein the first tail is positioned such that a plane passing through the hinge axis and the cylinder axis of the first threaded surface passes through the first tail.

9. An electrical connector for a threaded shaft, said connector comprising:

a first connector element comprising a first partial-cylindrical threaded surface, a first hinge element, and a first tail;

a second connector element comprising a second partial-cylindrical threaded surface, a second hinge element, and a second tail;

said hinge elements coupled together at a hinge axis such that the connector elements rotate about the hinge axis to move the threaded surfaces toward and away from one another, said threaded surfaces oriented to contact and intermesh with opposed sides of the threaded shaft;

a fastener operative to hold the tails together to clamp the threaded shaft between the threaded surfaces;

wherein the fastener is operative to elastically deform the second tail when clamping the threaded shaft between the threaded surfaces, thereby providing a spring compression effect that maintains a contact force urging the threaded surfaces against the threaded shaft.

10. An electrical connector for at least one cable and at least one threaded shaft, said electrical connector comprising:

a first connector element comprising a first tail, a socket, a first hinge element, and a first partial-cylindrical threaded surface, said socket comprising an opening and said first tail comprising a protruding element;

a second connector element comprising a second partial-cylindrical threaded surface, a second hinge element, and a second tail;

said hinge elements coupled together at a hinge axis such that the second connector element rotates about the hinge axis to move the threaded surfaces toward and away from one another, said threaded surfaces oriented to contact and intermesh with opposed sides of the threaded shaft;

a third connector element comprising a partial-cylindrical head pivotably received in the socket and a third tail, said third connector element comprising an opening in the head positioned to align with the opening in the first connector element in a first position of the third connector element in the socket, and to misalign with the opening in the first connector element in a second position of the third connector element in the socket, said third tail comprising a window communicating with the opening in the head;

said protruding element positioned to extend into the window when the third connector element is in the second position.

11. The connector of claim 10 wherein first connector element comprises an elongated flange extending away from the first tail, said flange forming at least a portion of the socket, at least a portion of the first threaded surface, and the first hinge element.

12. The connector of claim 10 wherein a plane passing through the hinge axis and the pivot axis passes through the first tail, and wherein the first tail and the hinge axis extend on opposite sides of the pivot axis.

13. The connector of claim 10 wherein each threaded surface extends over a cylinder arc of less than 180°.

14. The connector of claim 10 wherein each threaded surface extends over a cylinder arc of less than 160°.

15. The connector of claim 10 wherein each threaded surface extends over a cylinder arc of less than 140°.

16. The connector of claim 10 wherein each threaded surface extends over a cylinder arc of no more than about 135°.

17. The connector of claim 10 wherein the threaded surfaces define respective cylinder axes, and wherein the cylinder axes are parallel with the hinge axis.

18. The connector of claim 17 wherein the head of the third connector element pivots in the socket about a pivot axis, and wherein the pivot axis is substantially parallel to the hinge axis.

19. The connector of claim 17 wherein the cylinder axes pass through the head when the threaded surfaces are positioned to intermesh with the threaded shaft.

20. The connector of claim 10 wherein the head of the third connector element pivots in the socket about a pivot axis, and wherein the pivot axis is parallel to the hinge axis.

21. The connector of claim 20 wherein the second and third connector elements are positioned side by side on the first connector element.

22. The connector of claim 10 further comprising:

a first fastener extending through the first and second tails and operative to clamp the threaded surfaces on the threaded shaft; and a second fastener extending through the first and third tails and operative to clamp the third connector element in the second position with a cable extending through the openings and contacting the protruding element.

23. The connector of claim 22 wherein the first fastener is operative to elastically deform the second tail when clamping the threaded shaft between the threaded surfaces, thereby providing a spring compression effect that maintains a contact force urging the threaded surfaces against the threaded shaft.

* * * * *